235-379 SR
2/23/88 XR 4,726,474

United States Patent [19]

Arikawa et al.

[11] Patent Number: 4,726,474

[45] Date of Patent: Feb. 23, 1988

[54] CIRCULATING-TYPE BILL DEPOSITING AND DISBURSING MACHINE

[75] Inventors: Junichi Arikawa; Hiroshi Chiba, both of Urawa; Osamu Miyazaki, Kawaguchi; Masatoshi Osanai, Urawa, all of Japan

[73] Assignee: Laurel Bank Machines Co., Ltd., Tokyo, Japan

[21] Appl. No.: 729,111

[22] Filed: Apr. 30, 1985

[30] Foreign Application Priority Data

May 8, 1984 [JP] Japan ..... 59-91516
May 8, 1984 [JP] Japan ..... 59-91517

[51] Int. Cl.[4] ..... B07C 5/36

[52] U.S. Cl. ..... 209/534; 109/24.1; 194/206; 235/379; 271/3.1

[58] Field of Search ..... 209/534, 551; 109/24.1; 194/205-207; 235/379; 271/3.1, 157, 3, 4, 9

[56] References Cited

U.S. PATENT DOCUMENTS

| | | | |
|---|---|---|---|
| 4,045,017 | 8/1977 | Lundblad | 194/207 X |
| 4,343,582 | 8/1982 | Lundblad et al. | 414/32 |
| 4,365,700 | 12/1982 | Arimoto et al. | 194/206 |
| 4,369,360 | 1/1983 | Tsuji | 235/379 |
| 4,418,824 | 12/1983 | Gorgone et al. | 209/534 |
| 4,423,826 | 1/1984 | Hirata et al. | 109/24.1 X |
| 4,465,192 | 8/1984 | Ohba et al. | 209/534 |
| 4,465,193 | 8/1984 | Kokubo et al. | 209/534 |
| 4,465,925 | 8/1984 | Goi | 209/534 X |
| 4,510,380 | 4/1985 | Uchida, deceased, et al. | 194/206 |
| 4,511,795 | 4/1985 | Wood et al. | 235/379 |
| 4,577,763 | 3/1986 | Placke et al. | 209/534 |
| 4,607,155 | 8/1986 | Nao et al. | 235/379 |

FOREIGN PATENT DOCUMENTS

| | | | |
|---|---|---|---|
| 109743 | 5/1984 | European Pat. Off. | 209/534 |
| 54-42199 | 4/1979 | Japan | 194/206 |
| 54-111400 | 8/1979 | Japan | 235/379 |
| 56-63664 | 5/1981 | Japan | 235/379 |
| 56-94464 | 7/1981 | Japan | 235/379 |
| 57-75371 | 5/1982 | Japan | 235/379 |
| 57-209568 | 12/1982 | Japan | 235/379 |
| 59-207336 | 11/1984 | Japan | 271/157 |

OTHER PUBLICATIONS

Currency Cartridge, IBM Technical Disclosure Bulletin, vol. 18, No. 1, Jun. 1975, R. J. Laybourn and J. L. Monday, p. 237.

*Primary Examiner*—Robert B. Reeves
*Assistant Examiner*—Edward M. Wacyra
*Attorney, Agent, or Firm*—Fleit, Jacobson, Cohn & Price

[57] ABSTRACT

The circulating-type bill depositing and disbursing machine includes a receiving and dispensing box. The receiving and dispensing box is adapted to be removably loaded into the machine. The box receives undamaged bills in the front portion thereof to allow the undamaged bills to be dispensed therefrom and also receives damaged bills in the rear portion thereof.

5 Claims, 19 Drawing Figures

CIRCULATING-TYPE BILL DEPOSITING AND DISBURSING MACHINE

BACKGROUND OF THE INVENTION

1. Field of the Invention

The present invention relates to a circulating-type bill depositing and disbursing machine which operates to deposit or recieve bills and disburse or dispense bills, and has a circulating and distributing function allowing received bills to be reused as disbursable or payable ones.

2. Prior Art

Conventionally, circulating-type bill depositing and disbursing machines have been installed in the branches of financial institutions, and the management of bills is effected as follows: In order to reduce operations at the time of starting and completing operations by using one detachable receiving and dispensing box, at the time of starting operations, payable bills of mixed denomination inside the receiving and dispensing box are distributed to storage sections to be dispensed for each type of bill inside a machine body, and, at the time of completing operations, bills inside these storage sections for each type of bill are collected and stored into the receiving and dispensing box.

Then, during operation, received bills are housed in this receiving and dispensing box, and in cases where undamaged bills for dispensation have become short in supply, undamaged bills of the denomination in short supply are distributed from amongst the bills inside the receiving and dispensing box, while the bills of other denominations are returned to and stored in the receiving and dispensing box.

Among the bills received, however, there are often many damaged bills which are unsuitable for reuse. Although these damaged bills have also heretofore been included among those to be distributed, this deteriorates the efficiency of replenishing the stock of bills for dispensation with surplus undamaged bills, and the operation of sorting the bills into undamaged and damaged ones at the time of completing operations is made difficult.

SUMMARY OF THE INVENTION

Accordingly, an object of the invention is to provide a circulating-type bill depositing and disbursing machine which effectively overcomes the aforementioned drawbacks of the prior art and which makes it possible to dispense bills which are sorted and stored in the receiving and dispensing box by connecting said bills positively with a dispensing route, and which is advantageous in its method of carrying of the receiving and dispensing box and in the management of bills.

The present invention is arranged as follows: Bills received are sorted out into undamaged and damaged bills and stored, and the undamaged bills are protected by an openable cover. At the same time, when the receiving and dispensing box is loaded in the machine body, the openable cover is opened, and, at that juncture, the undamaged bills released are pressed with a front surface guide plate and a lower end surface guide plate, and the front and lower surfaces of undamaged bills to be coupled with a dispensing route are thus pressed, thereby making it possible to dispense the bills.

DESCRIPTION OF THE DRAWINGS

One embodiment of the present invention will be now discribed in detail with reference to the accompanying drawings in which.

DESCRIPTION OF THE PREFERRED EMBODIMENT

Description of the present invention will be made hereafter with respect to a case where the invention is used as a circulating-type bill depositing and disbursing machine for window use which is used by a teller (a window clerk) at the window of a financial institution such as a bank.

Figure 1:
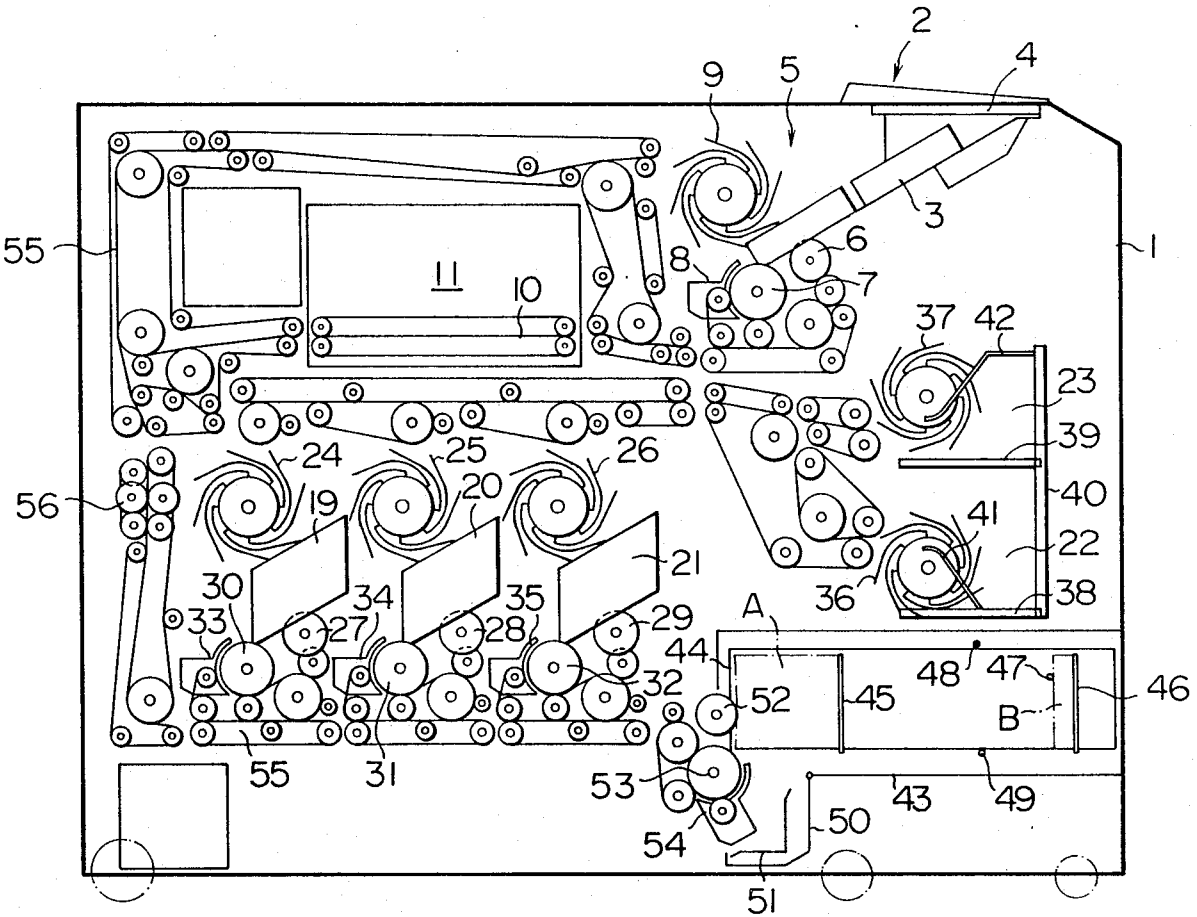
FIG. 1 is a schematic diagram of a circulating-type bill depositing and disbursing machine for window use.
Figure 2:
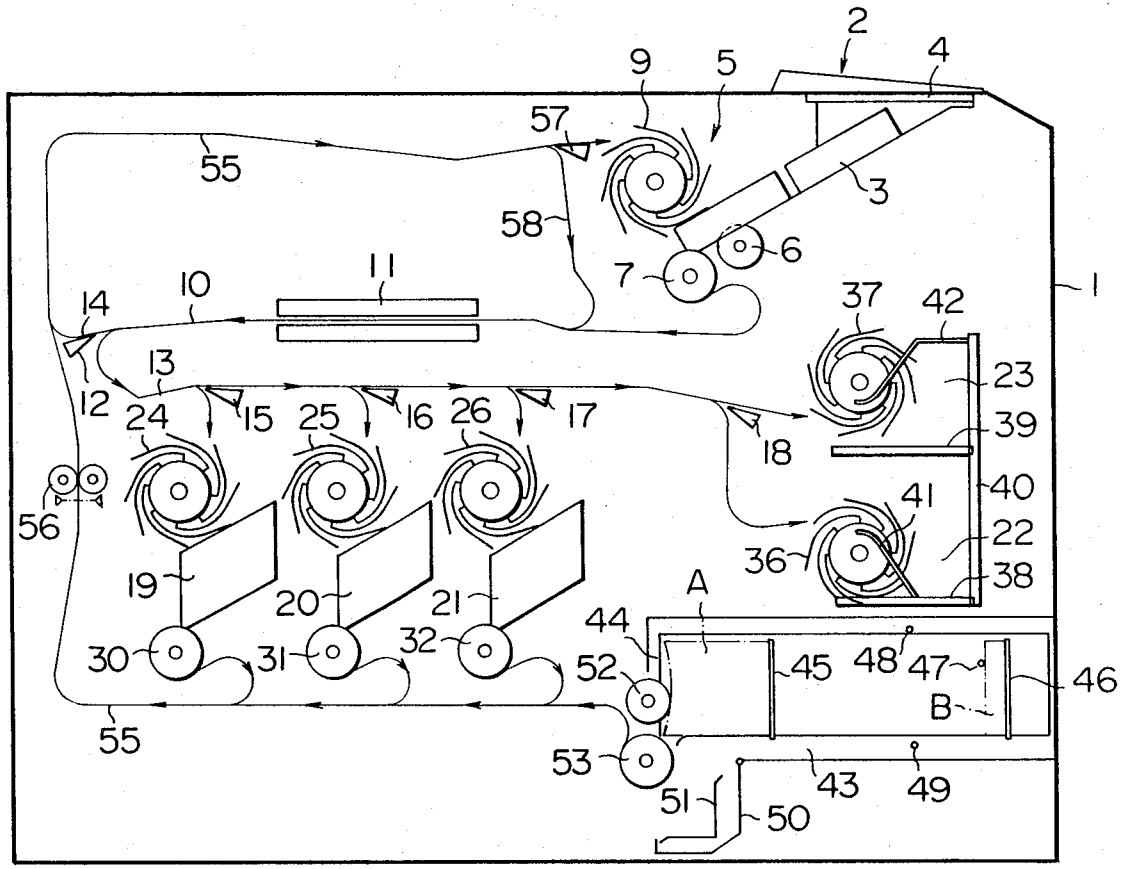
FIG. 2 is a route diagram explaining the flow of bills through each of the component parts shown in FIG. 1.

FIG. 1 is a schematic diagram illustrating one embodiment of a circulating-type bill depositing and disbursing machine for window use according to the present invention. FIG. 2 is a route diagram explaining the flow of bills to and from the respective component elements shown in FIG. 1.

In the figures, reference numeral 1 denotes a machine body of a circulating-type bill depositing and disbursing machine, and reference numeral 2 denotes a dealing port mechanism. This dealing port mechanism 2 comprises a depositing and disbursing bill sorting section 3 for receiving bills to be deposited and for storing bills to be disbursed, a shutter 4 for opening and closing this depositing and disbursing bill storing section 3 from outside the machine body 1, and an accumulating and feeding section 5 located at the rear of the depositing and disbursing bill storing section 3. This accumulating and feeding section 5 is arranged such that it has a kick-out roller 6, a feeding roller 7, and a friction-separating member 8 so that received bills sent from the depositing and disbursing bill storing section 3 can be conveyed by feeding said bills one by one, and it also has an accumulating wheel 9 so that bills to be disbursed which have been conveyed from disbursing bill storing sections 19 to 21 for each type of bill, which will be described later, can be accumulated.

Additionally, the dealing port mechanism 2 is provided with the following: a partitioning member for partitioning the depositing and disbursing bill storing section 3 and the accumulating and feeding section 5; a receiving and delivering mechanism for receiving deposited bills and delivering bills to be disbursed between the depositing and disbursing bill storing section 3 and the accumulating and feeding section 5; and pressing pieces (not shown) which press received bills against the kickout roller 6 at the time of handling received bills and which separate from undelivered bills those bills which were not recognized as bills at a discriminating section 11, which will be explained later.

Received bills which are separated and conveyed by the accumulating and feeding section 5 are conveyed by a discrimination route 10. The discriminating section 11 is provided midway in the discrimination route 10 and is adapted such that discrimination can be effected with regard to the genuineness of the bills being conveyed, their denomination, obverse and reverse sides, whether or not they are damaged, etc.

The discrimination route 10 in the latter part of the discriminating section 11 is divided into a distribution route 13 and a rejection route 14 by means of a distributing fork 12.

Distributing forks 15, 16, 17 and 18 are provided at four places along the distribution route 13. Bills distributed by the distributing forks 15 to 18 are respectively accumulated and stored in a disbursing bill storing part 19 for ¥10,000 bills, a disbursing bill storing part 20 for ¥5,000 bills, a disbursing bill storing part 21 for ¥1,000 bills, a first storing part 22 and a second storing part 23.

The rejection route 14 is connected to the middle section of a disbursing route 55, which will be described later, and this disbursing route 55 is connected to the accumulating wheel 9 of the accumulating and feeding section 5.

The disbursing bill storing section 19 for ¥10,000 bills, the disbursing bill storing section 20 for ¥5,000 bills and the disbursing bill storing section 21 for ¥1,000 bills are respectively disposed horizontally and are arranged by combining accumulating wheels 24, 25 and 26, kickout rollers 27, 28 and 29, feeding rollers 30, 31 and 32, and friction-separating members 33, 34 and 35, respectively, and the bills are accumulated in an inclined state.

The first storing part 22 and the second storing part 23 are disposed vertically on the terminal side of the distribution route 13 and are arranged by combining accumulating wheels 36 and 37, storing bottom plates 38 and 39, a storing front plate 40 (integrally formed), and guide plates 41 and 42.

The accumulating directions of the respective accumulating wheels of the first storing part 22 and the second storing part 23 are set in opposing directions. Bills fed in from above the accumulating wheel 36 of the first storing part 22 are accumulated in an upright state on the storing bottom plate 38 between the accumulating wheel 37 and the storing front plate 40 by means of the guide plate 41, while bills fed in from below the accumulating wheel 37 of the second accumulating part 23 are accumulated, in an upright state, in the direction opposite to that of the bills of the first bill storing part 22 on the storing bottom plate 39 between the accumulating wheel 37 and the storing front plate 40 by means of the guide plate 42.

It is desirable to provide a belt moving at least on the storing bottom plate 39 toward the storing front plate 40 side, so that the rear-end side of the accumulated bills will be fed positively to the storing front plate 40 side at the time when the bills are accumulated at the second storing part 23 (refer to a belt 39*a* in FIG. 11 A).

Next, description will be made of the receiving and dispensing box 43, which has a special bearing on the purpose of the present invention. The arrangement of this receiving and dispensing box 43 is such that this box is disposed below the first and second storing parts 22 and 23 and is detachable with respect to the machine body 1, an undamaged bill storing section A for storing undamaged bills in an upright state is provided in the front portion of the receiving and dispensing box 43 as seen from the mounting direction, and a damaged bill storing section B for storing damaged bills in an upright state is provided at the rear thereof.

In other words, undamaged bills are clamped between a front plate 44 and a reciprocating plate 45, while damaged bills are clamped between a rear plate 46 and a transverse pair of damaged bill holding bars 47, 47, and the front plate 44, reciprocating plate 45, and rear plate 46 are supported such as to be horizontally movable, as will be explained later.

In the figures, reference numerals 48, 48 denote a transverse pair of undamaged bill holding bars at the time of storing undamaged and damaged bills, while reference numerals 49, 49 denote a transverse pair of temporary holding bars at the time of storing undamaged bills, the detailed overall description of which will be made later.

An openable cover 50 is openably provided in the front and lower portion of the receiving and dispensing box 43 as seen from the mounting direction. A front receiving plate 51 with an L-shaped section for receiving undamaged bills to be stored is provided in the openable cover 50.

Furthermore, a kick-out roller 52, a feeding roller 53, and a friction-separating member 54, which can be engaged with the receiving and dispensing box 43 to feed undamaged bills from inside the box 43 at the time of mounting the box 43, are provided in said front and lower portion of the receiving and dispensing box 43 as seen from the mounting direction and in a state wherein they are supported by the machine body 1.

The bills which are separated and fed out one by one from the respective disbursing bill storing parts 19, 20 and 21 and the receiving and dispensing box 43 are conveyed by the disbursing route 55. A disbursing bill feed discriminating part 56 is provided midway along the disbursing route 55 and is adapted to be capable of judging any abnormality in the feeding of bills being conveyed (double feed, longitudinal feed, and proximity feed and the like).

The latter section of the rejection route 14 joins and is connected to the latter section of the disbursing route 55 following the disbursing bill feed discriminating part 56, and this disbursing route 55 is connected to the accumulating wheel 9 of the accumulating and feeding section 5.

Also, a transfer route 58 for transferring bills to the discrimination route 10 in the first portion of the discriminating section 11 by means of a distributing fork 57 branches out and is connected to the vicinity of the rear end of this disbursing route 55.

Description will be made hereinafter of the detailed mechanism of the receiving and dispensing box 43 with reference to FIGS. 3 through 10.

Figure 3:
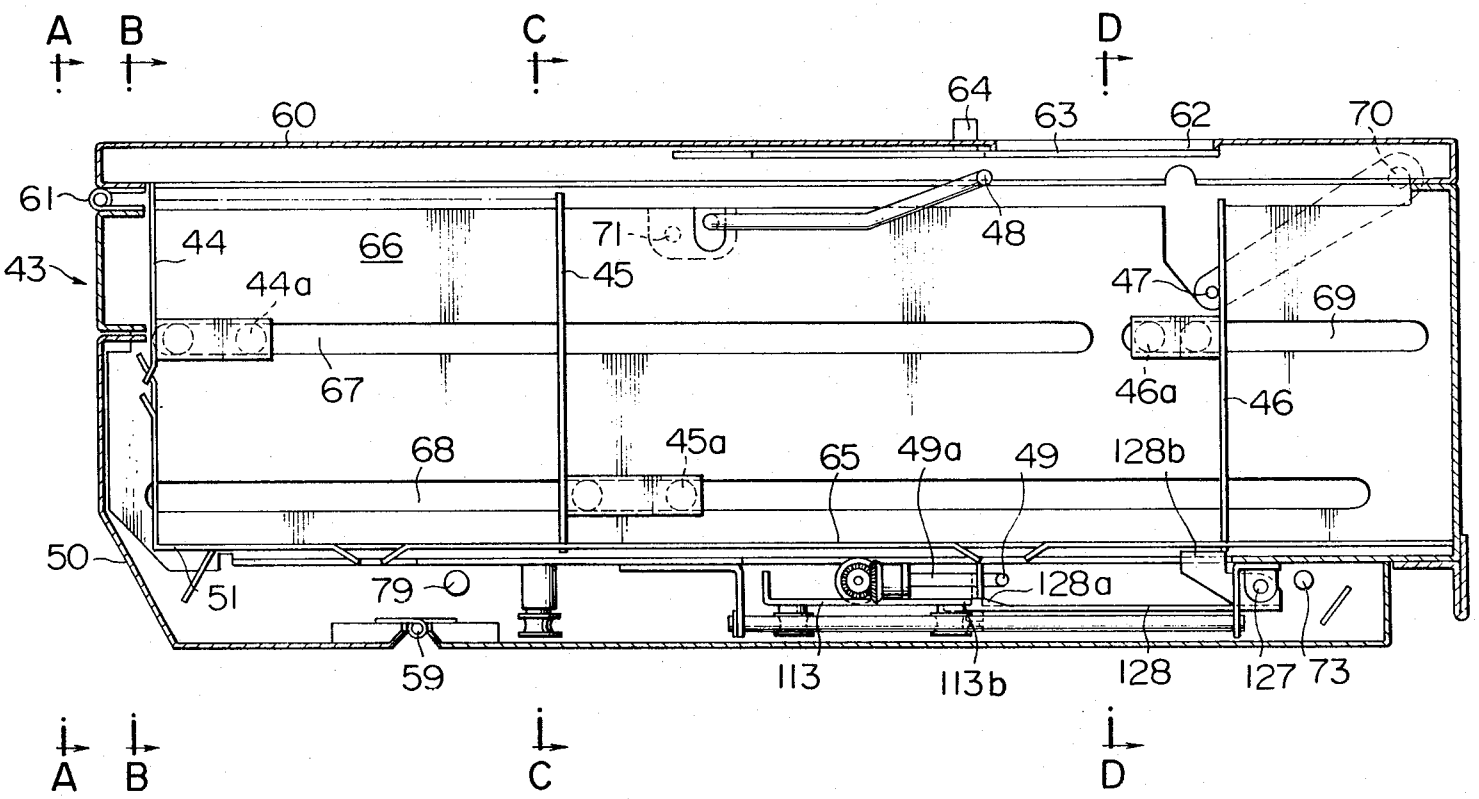
FIG. 3 is a central cross-sectional view of a receiving and dispensing box.
Figure 4:
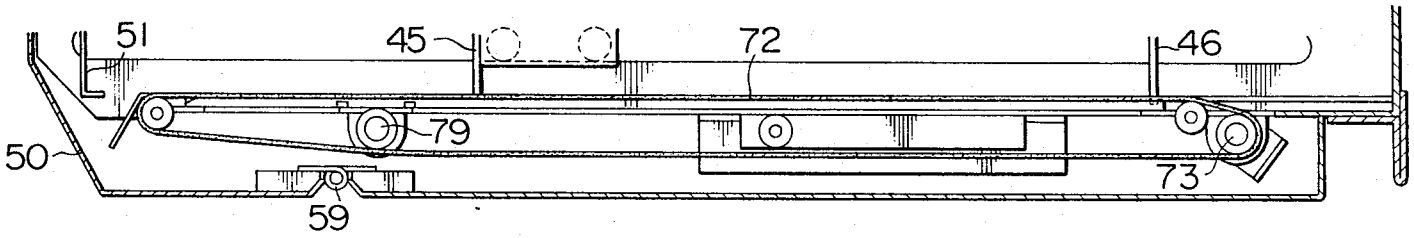
FIG. 4 similarly shows a partial cross-sectional view of the vicinity of the central portion of the receiving and disbursing box.

As is mainly shown in FIGS. 3 and 4, the openable cover 50 is opened by means of a hinge 59 at the front and lower portion in the mounting direction of the receiving and dispensing box 43 (at lower left in the figures). A roller 50a which is guided by a releasing cam 133 which unlocks at the time of mounting, which is shown by an alternate long and short dash line in FIG. 9 and will be described later, is provided to this openable cover 50 so as to open said cover 50.

Meanwhile, an upper cover 60 which is opened at the time of loading or taking out bills is opened at the upper portion of the receiving and dispensing box 43 by means of a hinge 61.

Formed in this upper cover 60 is an opening 62 for storage which enables the insertion of bills accumulated in the first storing part 22 and the second storing part 23 into the receiving and dispensing box 43, and a slidable opening and closing plate 63 for opening and closing this opening 62 for storage provided therein.

This opening and closing plate 63 is provided with an engaging piece 64. At the time when the receiving and dispensing box is mounted in the machine body 1, this engaging piece 64 is engaged with a portion of the machine body 1 so as to open the opening 62 for storage.

A bill supporting plate 65 for mounting bills is provided in the receiving and dispensing box 43, and is adapted such that the mounting surface of this supporting plate 65 and the horizontal surface of the front receiving plate 51 at the time when the opening and closing cover 50 is closed will agree with each other.

Figure 8:
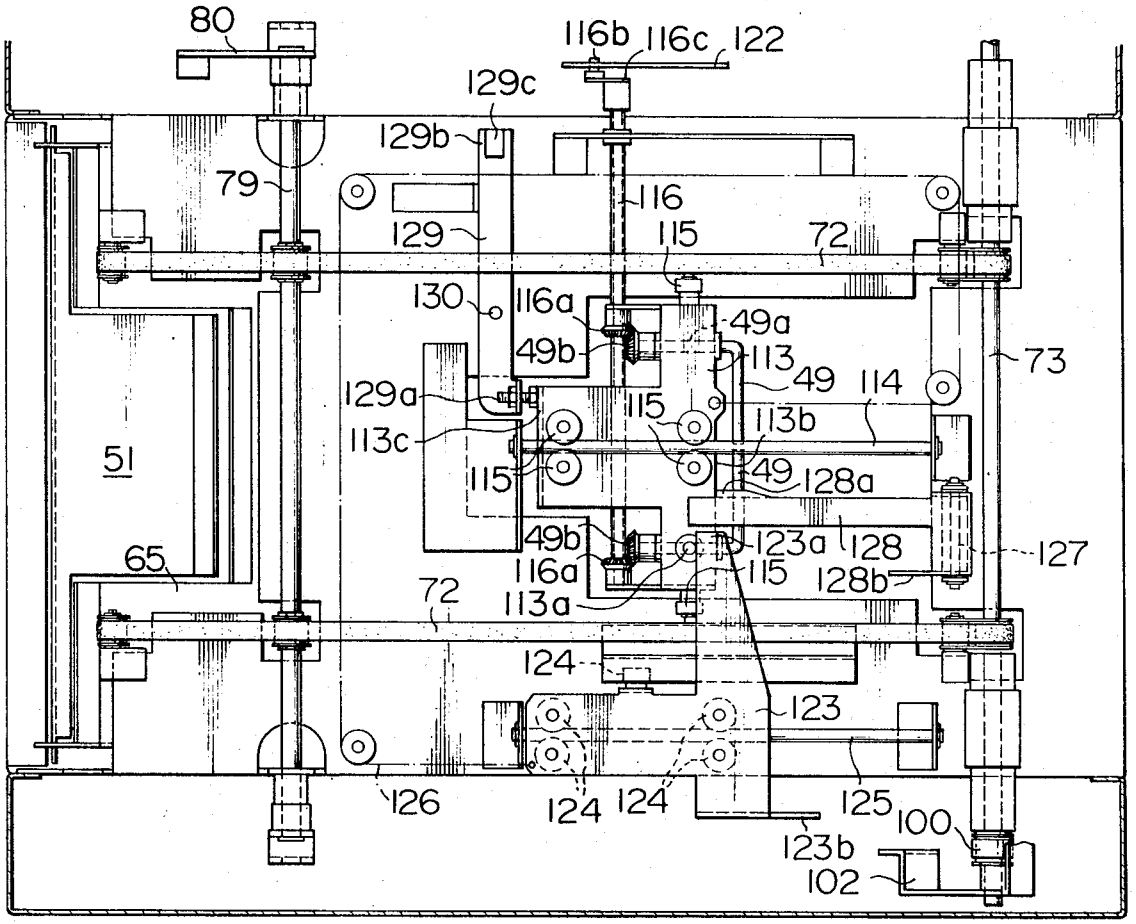
FIG. 8 is a cross-sectional view of the bottom of the receiving and dispensing box 43.

As for the front portion of this supporting plate 65 as seen from the mounting direction, its central portion is formed in a U-shape, as shown at the left portion of FIG. 8. The horizontal portion of the front receiving plate 51 at the time when the openable cover 50 is closed is inserted into this U-shaped portion.

Accordingly, the horizontal portion of the front receiving plate 51 is formed more narrowly than the width of its vertical part.

As shown in FIG. 3, an engaging portion 44a such as a roller or the like is provided on the side of the front plate 44, and this engaging portion 44a is supported such as to be horizontally movable along a guide groove 67 formed on the side plates 66, 66 inside the receiving and dispensing box. This engaging portion 44a is normally locked in the position shown in FIG. 5 by means of a mechanism shown therein, which will be described later. The front plate 44 is arranged such that the vertical surface of the front plate 44 in this position and the vertical surface of the front receiving plate 51 at the time when the openable cover is closed will agree with each other.

The reciprocating plate 45 is also provided with an engaging portion 45a such as a roller or the like, as shown in FIG. 3. The reciprocating plate 45 is supported such as to be horizontally movable along a guide groove 68 formed in the side plates 66, 66. A spring (not shown) is interposed between this reciprocating plate 45 and the front plate 44 so as to be capable of clamping bills (undamaged ones) between the two plates 44 and 45. At the same time, the front plate 44 and the overall reciprocating plate 45 in a clamped state, are, urged by another spring (not shown) so as to be backwardly movable.

The rear plate 46 is also provided with an engaging portion 46a, as shown in FIG. 3, and is supported so as to be horizontally movable along a guide groove 69 formed in the side plates 66, 66. This rear plate 46 is urged by a spring (not shown) in the direction of clamping bills (damaged ones) between the damaged bill holding bars 47, 47.

The pair of damaged bill holding bars 47, 47 are arranged such as to be vertically swingable about shafts 70 by means of the mechanism shown in FIG. 5, which will be described later, and are further arranged so as to project inwardly by approximately ¼ of the length of the side plates 66, 66 so as to be capable of clamping bills (damaged ones) between the same and the rear plate 46, as shown in FIG. 10 D.

The undamaged bill holding bars 48, 48 are arranged such as to be swingable about shafts 71 by means of a mechanism shown in FIG. 5, which will be described later, and is further arranged so as to project inwardly by approximately ¼ of the length of the side plates 66, 66, as in the case of the damaged bill holding bars 47, 47, as shown in FIG. 10 C, so as to clamp bills (undamaged ones) between the same and the front plate 44 only at the time of storing undamaged and damaged bills.

The temporary holding bars 49, 49 are arranged so as to be swingable about shafts 49a, 49a by means of the mechanisms shown in FIGS. 5 and 8, which will be described later, and are further arranged so as to be inclined or vertical in accordance with the position of the reciprocating plate 45, as shown in FIG. 10 C, so as to project above the mounting plate 65.

A pair of belts 72, 72 are provided in the vicinity of the side plates 66, 66 of the supporting plate 65, and this pair of belts 72, 72 move synchronously with the reciprocating plate 45 via a drive shaft 73 by virtue of a mechanism shown in FIG. 5, which will be described later, thereby aiding the movement of bills (undamaged ones).

Figure 7:
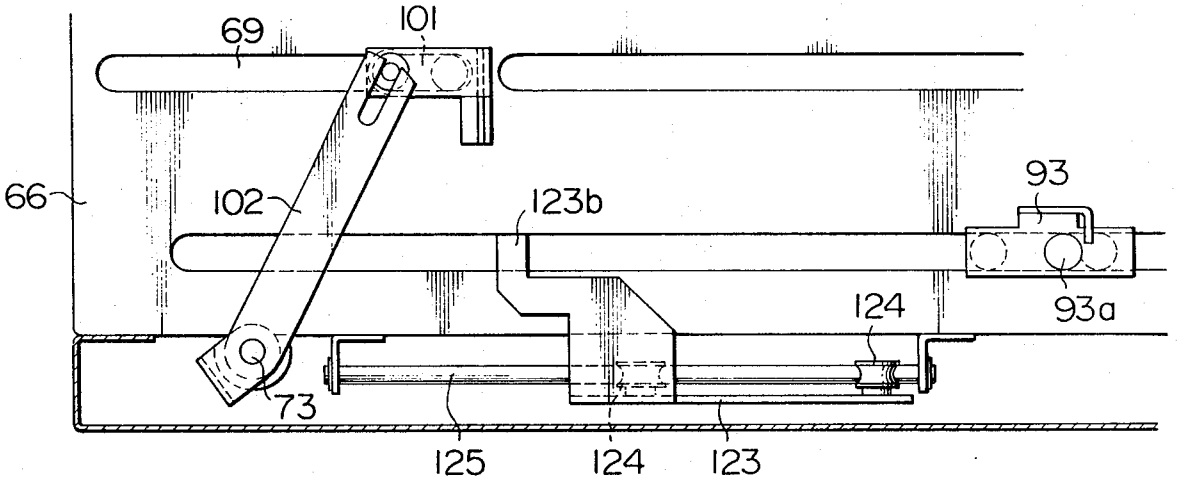
FIG. 7 is a partial vertical cross-sectional view of the opposite side of the receiving and dispensing machine shown in FIG. 5.

Next, description will be made mainly referring to FIGS. 5 through 7.

A coupling member 74, on which the front plate 44 is installed, is provided so as to be horizontally movable along the guide groove 67 formed in the side plate 66. Furthermore, an engaging roller 75 and a belt 76 trained at a position above and along the guide groove 67 for facilitating the movement of the front plate 44 are provided to this coupling member 74. Additionally, the engaging roller 75 is retained by a front plate locking plate 78 which swings about a shaft 77.

Meanwhile, a front plate unlocking lever 80 which swings about a shaft 79 is provided in the front and lower section of the receiving and dispensing box 43 as seen from the mounting direction. This front unlocking lever 80 is caused to swing by a cam or the like operated by a motor (not shown) on the side of the machine body 1 at the time of storing bills.

The swinging of this front plate unlocking lever 80 is transmitted to the front plate locking plate 78 via a coupling lever 81 which swings about the shaft 77, thereby releasing the engagement of the engaging roller 75.

A holding bar lever 82 which swings integrally with the undamaged bill holding bar 48 about the shaft 71 is further coupled to the coupling lever 81. The front plate locking plate 78, the front plate unlocking lever 80, and the coupling lever 81 are coupled to this holding lever 82, and they are constructed such that the swinging of a locking lever 84 which swings about a shaft 83 can be locked at the tip of the locking lever 84.

The engagement between this locking lever 84 and the holding bar lever 82 is released as the coupling lever 87 moves rightwardly, as viewed in FIG. 5, in an interlinking relationship with a rotating member 86 which rotates at the time of mounting and is horizontally swingable about a shaft 85, by means of a unlocking and releasing cam 133 which unlocks at the time of mounting, the latter being shown by an alternate long and short dash line in FIG. 9 and will be described later.

This unlocking and releasing cam 133 which unlocks at the time of mounting, which is shown by an alternate long and short dash line and will be described later, rotates an openable cover unlocking member 89, which swings about a shaft 88 below the front and lower portion of the receiving and dispensing box 43. Further, the rotation of said unlocking member 89 in turn causes an openable cover lock 91 to swing about a shaft 90 (as shown in FIG. 6) thereby releasing the lock of the engaging pin 92 secured to the openable cover 50.

Next, a coupling member 93, to which the reciprocating plate 45 is attached, is provided so as to be horizontally movable along the guide groove 68 formed on the side plate 66.

A driving belt 94 for moving the reciprocating plate 45 is coupled to this coupling member 93 in a position above and along the guide groove 68.

A coupling gear 97 is secured to a belt roller 95, which is located forwardly as seen from the mounting direction, of the pair of belt rollers 95 and 96, between which the driving belt 94 is trained. This coupling gear 97 is coupled to a driving gear (not shown) on the side of the machine body 1, to which the motive power of a motor (not shown) is transmitted, thereby moving the driving belt 94.

Meanwhile, gears 98 and 99 and a coupling belt 100 are interposed between the other belt roller 96 and the driving shaft 73. As described before, as the reciprocating plate 45 (the coupling member 93) moves leftwardly as seen in FIG. 5, the driving shaft 73 rotates counterclockwise as seen in the figure, while the belt 72 on the supporting plate 65 shown in FIG. 4 also moves leftwardly as seen in the figure.

Furthermore, a coupling member 101, to which the rear plate 46 is attached, is provided such as to be horizontally movable along the guide groove 69 formed in the side plate 66.

A coupling arm 102 supported movably by the driving shaft 73 is coupled to this coupling member 101 so as to facilitate the movement of the rear plate 46 and is constantly rotatably urged to the damaged bill holding bar 47 side (leftwardly in the figure) by a spring (not shown).

A holding bar locking piece 104, which is swingable about a shaft 103, is retained at the arm portion which is swingable about the shaft 70 of the damaged bill holding bar 47. At the same time, a holding bar arm 106 which is swingable about a shaft 105 is engaged with that arm portion.

A synchronizing plate 108 is provided below the damaged bill holding bar 47, the holding bar locking piece 104, and the holding bar arm 106 and this synchronizing plate 108 swings about a shaft 107 as it is engaged with a roller **93*a* provided to the coupling member 93 of the reciprocating plate 45. An arm actuating piece 110, which is swingable about a pin 109, is supported by the swinging tip of this synchronizing plate 108**.

The upper engaging end **110*a* of this arm actuating piece 110 is arranged so as to be engageable in steps with the intermediate portion of the holding bar arm 106**.

An unlocking piece 112, which rotates about a shaft 111, is engaged at the intermediate portion of the arm actuating piece 110. This unlocking piece 112 is arranged such as to be capable of unlocking the damaged bill holding bar 47 as it engages with one end of the holding bar locking piece 104.

The relationship among these component parts is as follows: As the reciprocating plate 45 advances to the rear plate 46 side, the roller **93*a* of the coupling member 93 engages with the lower end surface of the synchronizing plate 108 so as to push up the same. In the early stage of this pushing up, the unlocking piece 112 is rotated by the arm actuating piece 110, thereby releasing the lock of the damaged bill holding bar 47 effected by the holding bar locking piece 104. In the latter stage of the pushing up, the holding bar arm 106 is made to swing upwardly by the upper engaging end 110*a* of the arm actuating piece 110, thereby moving the damaged bill holding bar 47** in an upwardly unlocked state.

Furthermore, after the pushing up of the synchronizing plate 108, at the time when the reciprocating plate 45 has passed the position of the damaged bill holding bar 47 toward the side of the rear plate 46, the roller **93*a* of the coupling member 93 is engaged with the lower engaging end 110*b* of the arm actuating piece 110 so as to rotate the same, which, in turn, releases the engagement of the upper engaging end 110*a* with the holding bar arm 106, thereby returning the holding bar arm 106 and the damaged bill holding bar 47** to their original positions below.

At this juncture, the engagement of the arm actuating piece 110 and the unlocking piece 112 is also released, with the result that the unlocking piece 112 and the holding bar locking piece 104 also return to their original positions.

Next, description of the operating mechanism of the temporary holding bars 49, 49 will be made mainly referring to FIG. 8.

The shaft portions **49*a*, 49*a* of the temporary holding bars 49, 49 are rotatably supported by a moving plate 113, which is provided with a multiplicity of guide rollers 115, 115, . . . so that it can move along a guide shaft 114, and on which a rotary shaft 116 is supported in orthogonal relation to the shaft portions 49*a*, 49*a***.

This rotary shaft 116 and the shaft portions **49*a*, 49*a* of the temporary holding bar 49 are coupled with each other by means of bevel gears 116*a*, 116*a* and 49*b*, 49*b*, respectively. As the rotary shaft 116 rotates by a ¼ turn, the temporary holding bars 49, 49 rotate from their horizontal positions to their vertical positions, as shown in FIG. 10 C**.

In addition, an arm **116*c*, which is provided with a pin 116*b* at a position eccentric from the rotating center of this rotary shaft 116, is secured to the projecting end side (upper side in FIG. 8) of the rotary shaft 116**.

Meanwhile, a pair of swingable links 119 and 120, which swing about a pair of shafts 117 and 118, are provided below the side plate 66 (the lower portion of FIG. 5). A pair of horizontal links 121 and 122 are provided at the upper and lower positions of this pair of swingable links 119 and 120, these respective links 119 to 122 constituting a horizontal link mechanism.

Moreover, a long groove **122*a* is formed in the horizontal link 122 located on the lower side of this horizontal link mechanism, and the pin 116*b* of the rotary shaft 116 is inserted into said long groove 122*a***.

Meanwhile, a pin **119*a* at the swinging end of one swingable link 119 is urged so as to be engaged with one end of the holding bar lever 82 which is integrally formed with the undamaged bill holding bar 48. This pin 119*a* is adapted such that, at the time when the undamaged bill holding bar 48** has been lowered, the pin 119*a* raises the horizontal link 122, thereby rotating the provisionally holding bars 49, 49 to their vertical positions.

Furthermore, the swinging edge 120*a* of the other swingable link 120 is arranged so as to be capable of being engaged with the pin 109 provided at the swinging end side of the synchronizing plate 108. To describe the engaging relationship between them, at the time when the undamaged holding bars 48, 48 have been lowered, the swinging edge 120*a* of the swingable link 120 is engaged with the pin 109 of the synchronizing plate 108, which, in turn, causes the temporary holding bars, 49, 49 to be rotated to the inclined state as shown in FIG. 10 C. Then, as described before, the reciprocating plate 45 retreats and pushes up the synchronizing plate 108, which, in turn, causes the aforementioned engagement to be released, with the result that the provisionally holding bars 49, 49 rotate to their vertical positions as shown in FIG. 10 C.

The long groove 122*a* of the horizontal link 122 is formed such as to be capable of moving even if the temporary holding bars 49, 49 are in their vertical positions, as will be explained later.

On the other hand, at a position adjacent to this moving plate 113 (lower side in FIG. 8), a movement urging plate 123 is supported such as to be capable of moving along a guide shaft 125 by a multiplicity of guide rollers 124, 124, . . . A spring 126, shown by an alternative long and short dash line, is stretched between this movement urging plate 123 and the moving plate 113. Normally, the pin 113*a* of the moving plate 113 and the engaging end 123*a* of the movement urging plate 123 are engaged.

In addition, the engaging end 123*b* of the other end of this movement urging plate 123 is arranged such as to be capable of being engaged with the roller 93*a* provided at the coupling member 93 of the reciprocating plate 45. Consequently, this movement urging plate 123 retreats as it is engaged with the reciprocating plate 45.

Furthermore, the engaging end 128*a* of a temporary hold restricting plate 128, which swings about a shaft 127, is engaged with the front edge 113*b* of the moving plate 113 as seen from the moving direction. At the same time, as for the engaging end 128*a* of this temporary hold restricting plate 128, the engagement thereof with the front edge 113*b* of the moving plate 113 is released as the releasing end 128*b* (refer to FIG. 3) of the temporary hold restricting plate 128 is pushed down by the lower end of the storing front plate 40 at the time of storing bills.

To describe the relationships among the moving plate 113, the movement urging plate 123, and the temporary hold restricting plate 128, the roller 93*a* of the coupling member 93 and the engaging end 123*b* of the movement urging plate 123 engage with each other midway in the retreat of the reciprocating plate 45, and the reciprocating plate 45 and the movement urging plate 123 integrally retreat to the position of passing the damaged bill holding bars 47, 47.

Meanwhile, the movement of the moving plate 113 is restricted by the temporary hold restricting plate 128, and, as mentioned earlier, the temporary holding bars 49, 49 change in this state from their inclined state to a vertical one and vice versa.

When bills (undamaged ones) are stored between the temporary holding bars 49, 49 and the reciprocating plate 45 with the temporary holding bars 49, 49 in a vertical state, as will be mentioned later, the lower end of the storing front plate 40 pushes down the releasing end 128*b* of the temporary hold restricting plate 128. and the temporary holding bars 49, 49 move in the vertical state to the reciprocating plate 45 side by means of the tensile strength of the spring 126 of the temporary holding bars 49, 49, thereby clamping bills (undamaged ones) together with the reciprocating plate 45. Subsequently, it becomes possible for the reciprocating plate 45, the temporary holding bars 49, 49 (moving plate 113), and the movement urging plate 123 to advance integrally.

Reference numeral 129 in FIG. 8 denotes a position detecting arm, which is arranged as follows. This position detecting arm 129 is supported rotatably about a shaft 130. When the rear end edge 113*c* of the moving plate 113 is engaged with the position detecting arm 129 and rotates the same, the actuating piece 129*c* secured to the other end 129*b* and including a magnet also moves, which in turn causes a detector (not shown) provided on the side of the machine body 1 to be actuated and to issue a signal.

This signal actuates a motor (not shown) for operating the front plate unlocking lever 80, which returns the undamaged bill holding bars 48, 48 to their upward positions and the temporary holding bars 49, 49 to their horizontal positions.

Next, description will be made with reference to FIG. 9 of the mounting and demounting relationships of the receiving and dispensing box 43 with respect to the machine body 1.

Figure 9:
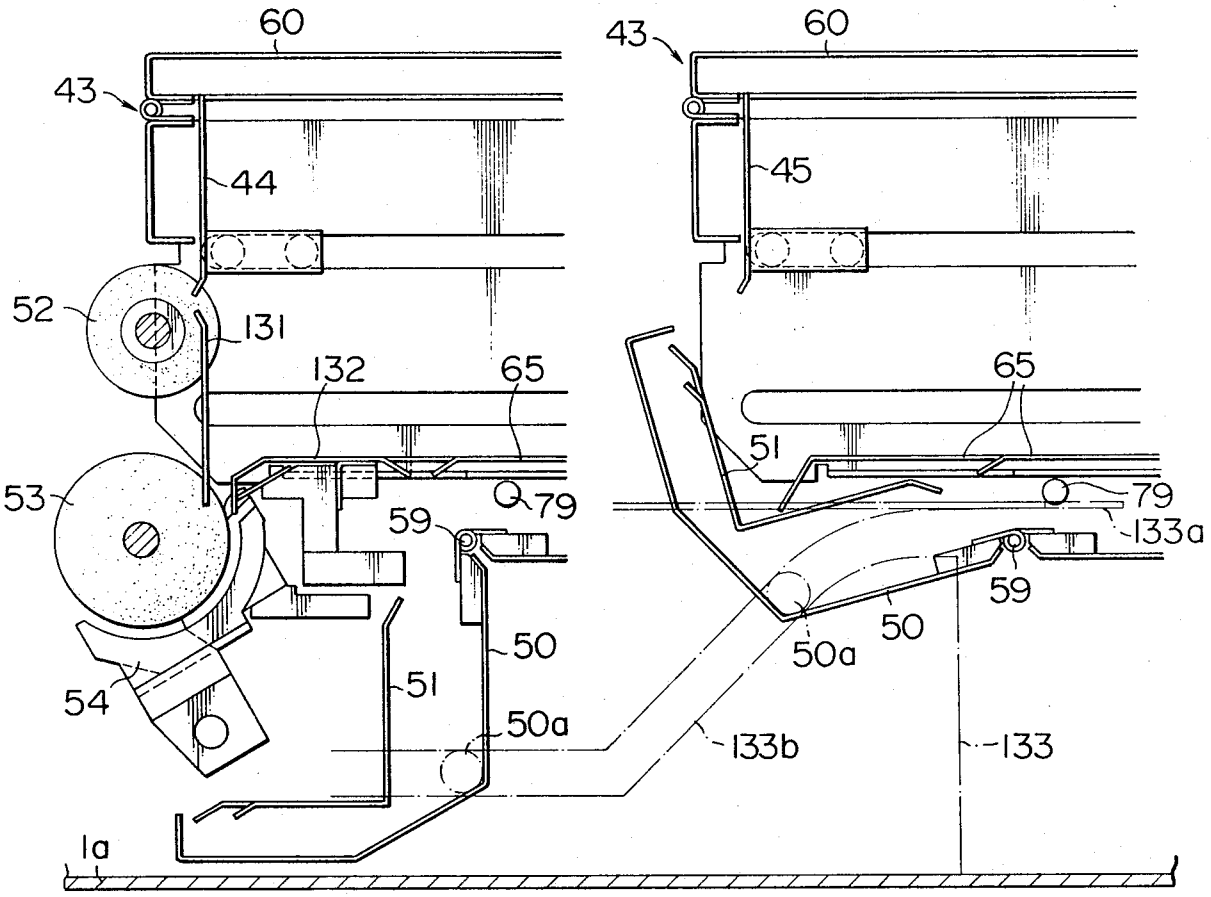
FIG. 9 is a diagram illustrating the relationships of the mounting and demounting of the receiving and dispensing box relative to the machine body.
Figure 10B:
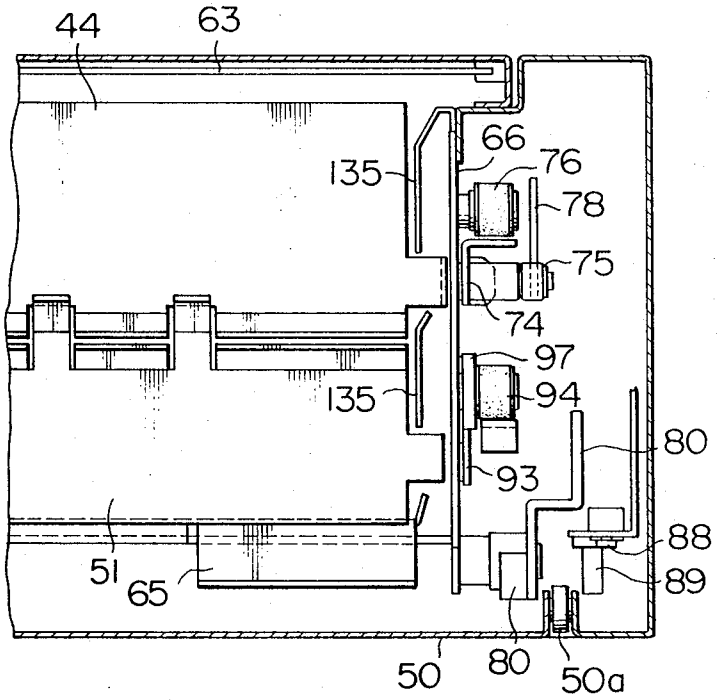
FIGS. 10 A–D show a front elevational view and cross-sectional views of the receiving and dispensing box, respectively.
Figure 10A:
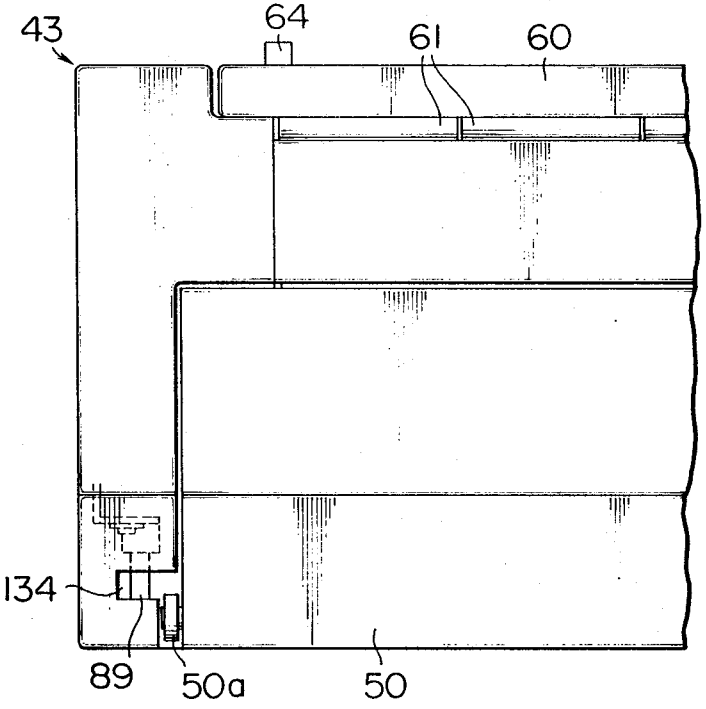
Figure 10D:
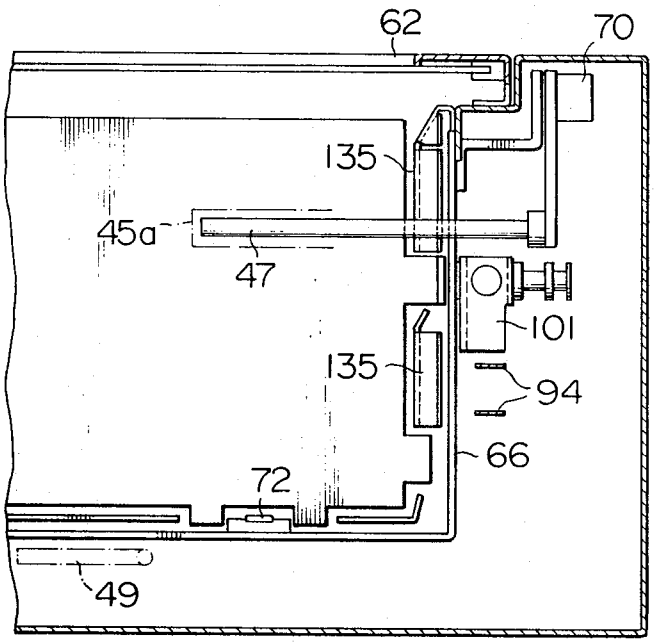
Figure 10C:
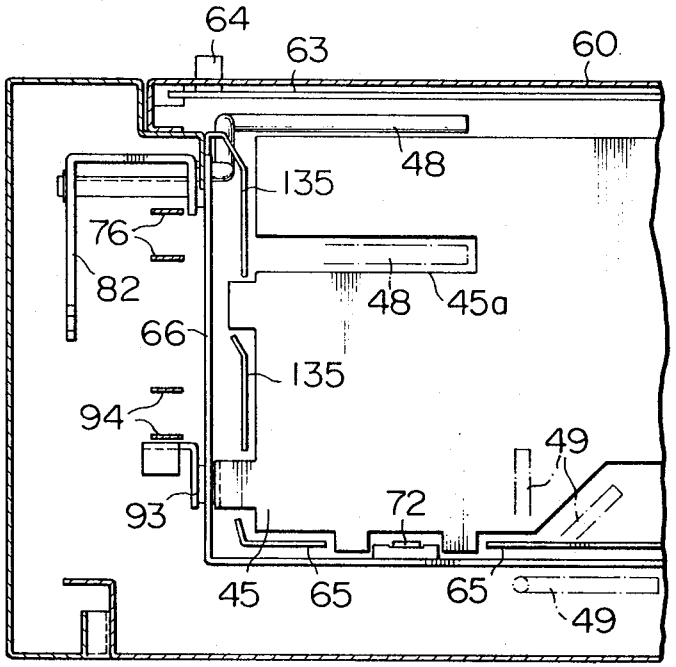

In FIG. 9, the kick-out roller 52, feeding roller 53, and friction-separating member 54 for dispensing and conveying bills (undamaged ones) stored inside the receiving and dispensing box 43 are provided on the base 1*a* of the machine body 1. At the same time, a front surface guide plate 131 for guiding the front lower portion of bills (undamaged ones) stored in the receiving and dispensing box 43 as well as a lower end surface guide plate 132 for guiding the side lower edge thereof are also provided on said base 1*a*.

At the time when the receiving and dispensing box 43 has been completely mounted in the machine body, the guide surfaces between the front surface guide plate 131 and the front plate of the receiving and dispensing box 43 agree with each other, and, at the same time, the surfaces of the lower end surface guide plate 132 and the supporting plate 65 also agree with each other (refer to the state of the receiving and dispensing box 43 shown on the left-hand side in FIG. 9).

In addition, the aforementioned unlocking and releasing cam 133 is provided on the base 1*a* of the machine body 1. This unlocking and releasing cam 133 comprises an unlocking portion 133*a* where a horizontal surface cam (its shape is not shown) is formed as well as a cover opening and closing portion 133*b* where a vertical surface groove cam is formed.

As the receiving and dispensing box 43 is mounted in the machine body 1, the unlocking portion 133*a* of this unlocking and releasing cam 133 is inserted into the receiving and dispensing box 43 through an opening 134 in the vicinity of the openable cover 50 shown in FIG. 10 A. As mentioned before, said unlocking portion 133*a* actuates the openable cover unlocking member 89 and the rotating member 86 which rotates at the time of mounting, as shown in FIGS. 5 and 6, thereby unlocking the openable cover 50 and the holding bar lever 82.

In addition, while the openable cover 50 is unlocked, the cover opening and closing portion 133*b* of this unlocking and releasing cam 133 guides the roller 50*a* secured to the openable cover 50 and opens or closes this openable cover 50.

FIGS. 10 A to D show a front elevation and cross sections of the receiving and dispensing box 43, and show only essential component parts which have already been described.

In the figures, reference numeral 135 denotes a guide plate for guiding the right-hand and left-hand portions of bills to be stored in the receiving and dispensing box 43.

The operation of the present invention will be described with reference to each of the operational diagrams shown in FIGS. 11 A to F.

First of all, when an instruction for deposit is issued, the shutter 4 shown in FIG. 2 is opened, and the teller loads the depositing and disbursing bill storing section 3 with the bills received from the customer.

Then, when an instruction as to the completion of loading is issued, the shutter 4 is closed, and the bills in the depositing and disbursing bill storing section 3 are fed out and moved to the accumulating section 5, and then separated and conveyed one by one.

These bills which are separated and conveyed one by one are discriminated by the discriminating section 11 of the discrimination route with regard to their genuineness, their denomination, obverse and reverse sides, whether or not they are damaged, etc. The bills judged to be genuine and reusable as bills for disbursement (i.e., the so-called undamaged bills) are conveyed to the first storing part via the distribution route 13 and are accumulated in an upright position. On the other hand, those bills which are genuine and yet cannot be suitably reused as bills to-be disbursed due to staining, damage, or the like (i.e., the so-called damaged bills) are conveyed to the second storing part, also via the distribution route 13, and are accumulated in an upright position.

On the other hand, those bills which were judged not to be genuine (i.e., bills which were abnormally conveyed such as through double feed, or those which were highly stained, impossible to judge or so-called false bank notes, etc.) are returned to the accumulating and feeding section 5 via the rejection route 14 and the disbursing route 55, but, as mentioned before, they are separated from unjudged bills received by means of a holding piece (not shown) and accumulated there.

Meanwhile, in a case where an instruction for deposit has been given, the receiving and dispensing box 43 is set on stand-by so as to be able to store bills at any time. As shown in FIG. 2, undamaged bills are clamped between the front plate 44 and the reciprocating plate 45, are set on the opening side for dispensing out, and are located in the central portion of the receiving and dispensing box 43 by means of the front plate 44 and the undamaged bill holding bar 48, as shown in FIG. 11 A.

Figure 5:
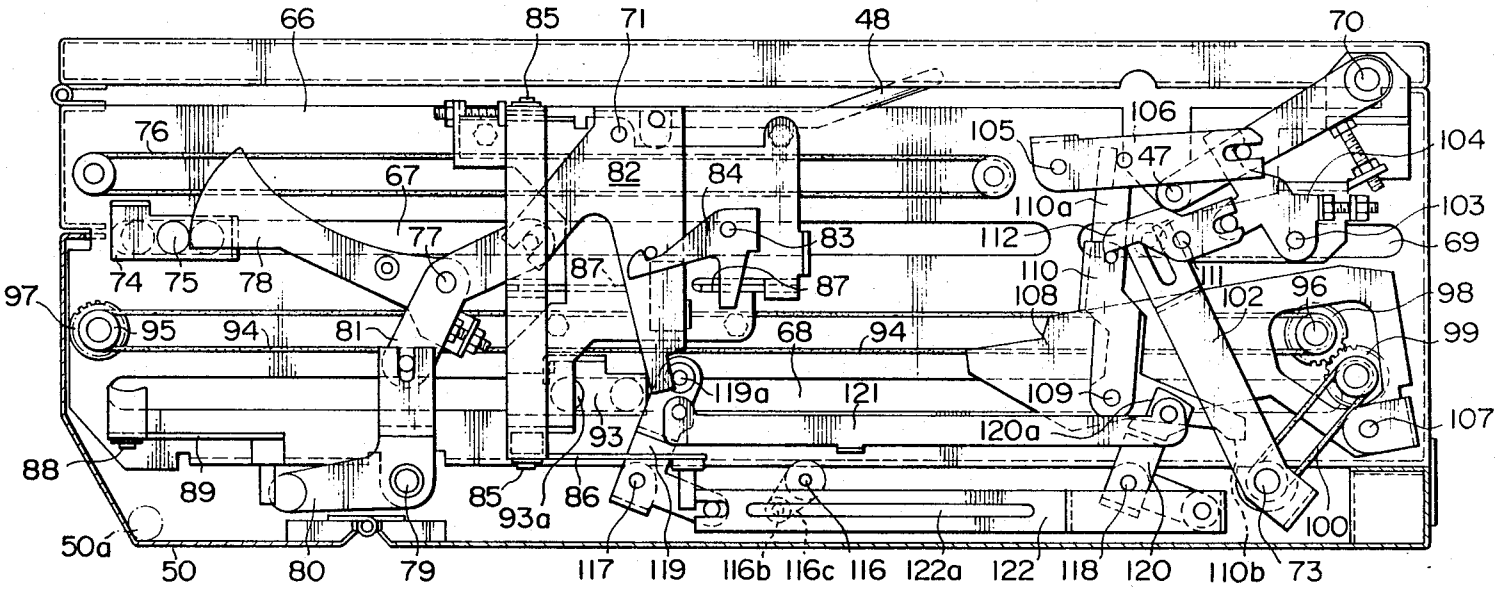
FIG. 5 is a vertical sectional side elevation of the receiving and dispensing box.
Figure 6:
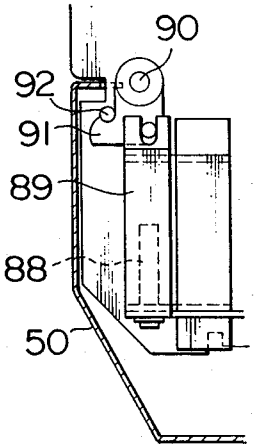
FIG. 6 is a partial vertical cross-sectional view thereof.

In other words, upon the issuance of an instruction for deposit, the front plate unlocking lever 80 is rotated clockwise as viewed in FIG. 5 by the operation of a motor (not shown). In conjunction with the rotation of the front plate unlocking lever 80, the engagement between the front plate locking plate 78 and the engaging roller 75 of the front plate 44 is released, and, at the same time, the undamaged bill holding bar 48 is lowered to the position shown in FIG. 11 A.

Additionally, at the same time, the temporary holding bar 49 is set in the inclined position shown in FIG. 10 C.

Then, the driving belt 94 is operated by the operation of another motor (not shown) via the coupling gear 97, and the undamaged bills clamped between the front plate 44 and the reciprocating plate 45 are integrally retracted to the rear plate 46 side.

When the reciprocating plate 45 reaches the position of the undamaged bill holding bar 48 midway in this retraction, since a notch 45*a* (refer to FIG. 10 C) is formed in this reciprocating plate 45 to allow it to avoid the undamaged bill holding bar 48, the reciprocating plate 45 can retreat further, but the undamaged bills and the front plate 44 are prevented from retreating by the undamaged bill holding bar 48 and stop at the positions shown in FIG. 11 A.

As the reciprocating plate 45 retreats further, the synchronizing plate 108 rotates upwardly, as mentioned earlier, and the temporary holding bar 49 is set to its vertical position. At the same time, the damaged bill holding bar 47 begins to retreat upwardly, and the damaged bills are clamped between the reciprocating plate 45 and the rear plate 46, and at the same time, the damaged bill holding bar 47 returns to its original position and assumes the position shown in FIG. 11 A.

Figure 11C:
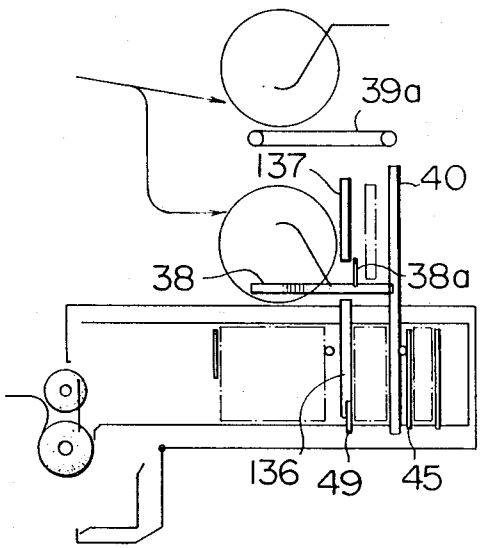
FIGS. 11 A–F are diagrams explaining the state of storing bills.
Figure 11B:
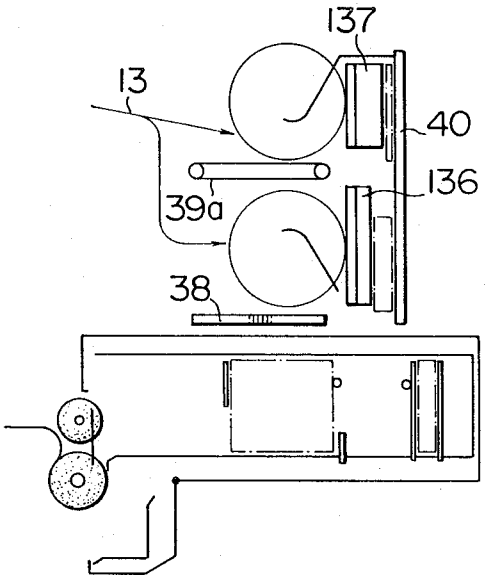
Figure 11A:
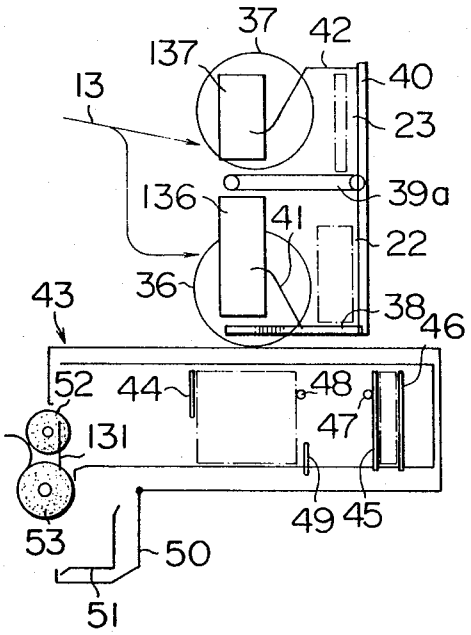
Figure 11F:
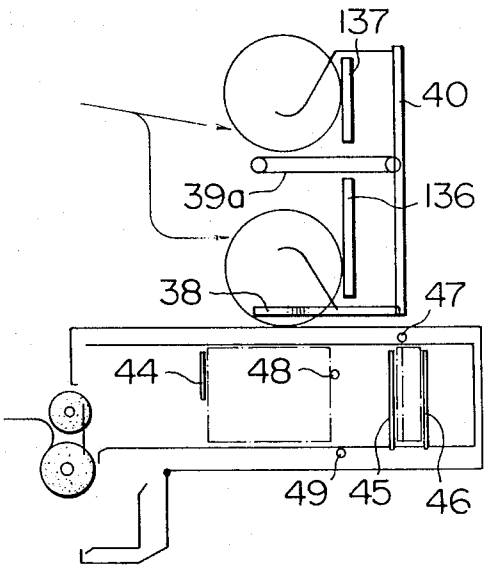
Figure 11E:
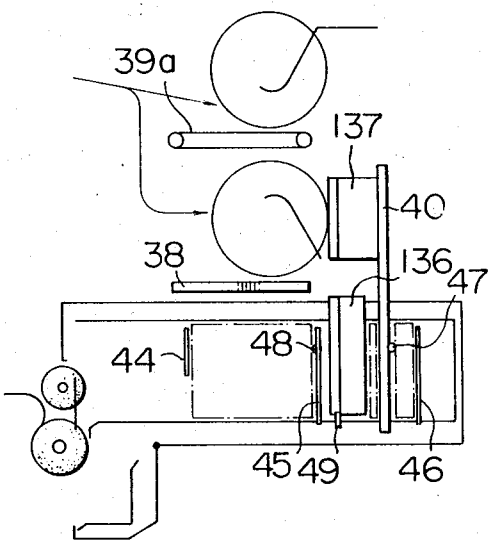
Figure 11D:
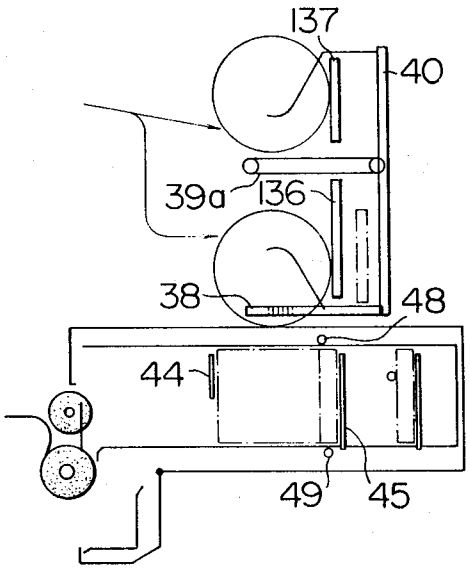

Reference numerals 136 and 137 shown in FIG. 11A denote holding plates which are rotated and retracted to both sides of the accumulating cars 36 and 37 by means of mechanisms (not shown) at the time of collecting undamaged and damaged bills, respectively. These holding plates 136 and 137 are arranged such that at the time of a storing operation they can rotate to the side of the storing front plate 40 and clamp the both sides of the undamaged bills in the first storing part 22 and the damaged bills in the second storing part 23.

Thus, if an instruction for deposit is issued after the receiving and dispensing box 43 is set on stand-by and the bills received are accumulated in the first storing part 22 and the second storing part 23 according to whether they are damaged or undamaged, the undamaged and damaged bills are clamped between the storing front plate 40 and the holding plates 136 and 137, as shown in FIG. 11 B.

After this clamping operation is completed, the storage bottom plates 38 and 39 (belt 39*a*) clamping the lower end of the bills at the time of accumulation of bills move for stand-by the side of the distribution route 13, as shown in FIG. 11 B.

The damaged and undamaged bills clamped between the storing front plate 40 and the holding paltes 136 and 137 are moved in the clamped state, as shown in FIG. 11 C, and only the undamaged bills clamped between the lower portion of the storing front plate 40 and the holding plate 136 are loaded between the reciprocating plate 45 and the temporary holding bar 49 through the opening 62 for storage of the receiving and dispensing box 43, while the damaged bills clamped between the upper portion of the storing front plate 40 and the holding plate 137 are moved to the vicinity of the first storing part 22.

At this juncture, since the lower end of the storing front plate 40 presses the unlocking end 128*b* of the temporary hold restricting plate 128 which restricts the clamping force of the temporary holding bar 49, thereby releasing the restriction, the temporary holding bar 49 presses the lower portion of the undamaged bills which are loaded toward the side of the reciprocating plate 45 so as to clamp the same.

After this downward movement, the storage bottom plates 38 and 39 (belt 39*a*), which were moved for stand-by, are returned to their original positions and are, at the same time, rotated and set in a horizontal state with respect to the storing front plate 40, thereby releasing the clamping of the undamaged and damaged bills.

Furthermore, at this juncture, a guide plate 38a is provided on the storage bottom plate 38 for guiding the damaged bills, which have been moved to the first storing part 22, to a position above the holding plate 136 without being caught. This guide plate 38a is rotated and set upright closer to the storing front plate 40 side than the position which the holding plates 136 and 137 pass, as shown in FIG. 11 C.

Next, as shown in FIG. 11 D, when the storing front plate 40 and the holding plates 136 and 137 are raised to their original positions, the undamaged bills clamped between the reciprocating plate 45 and the temporary holding bar 49 are added to and put together with the undamaged bills already being clamped.

In other words, when the reciprocating plate 45 advances in the direction of the front plate 44, which is opposite to the direction described above, the temporary holding bar 49 advances to its original position, causing the position detecting arm 129 shown in FIG. 8 to rotate, which, in turn, actuates a detector (not shown) on the machine body 1 side. By the operation of this detector, the front plate unlocking lever 80 rotates counterclockwise as seen in FIG. 5, i.e., in the direction opposite to that of the case where the aforementioned instruction for deposit is issued, causes the undamaged bill holding bar 48 to retreat to its upward position and the temporary holding bar 49 to retreat to its horizontal position.

As a result, the undamaged bills already stored and the undamaged bills to be newly stored are stored together. The reciprocating plate 45 stops when it passes the position of the undamaged bill holding bar 48 toward the side of the front plate 44, and, as in the case where the instruction for deposit is issued, lowers the undamaged bill holding bar 48 so as to ready itself for the operation of storing damaged bills.

The operation for storing damaged bills is effected when the reciprocating plate 45 is in the position of the undamaged bill holding bar 48, and the rest of the operational procedure is the same as in that for storing undamaged bills.

In other words, the damaged bills which have already been moved to the first storing part 22 are first clamped between the storing front plate 40 and the holding plate 136 (the holding plate also performs only the clamping operation).

Then, when the storage bottom plates 38 and 39 (belt 39a) have been moved for stand-by, the operation of storing the damaged bills in the receiving and dispensing box is commenced, and the damaged bills are loaded between the reciprocating plate 45 and the damaged bill holding bar 47.

At this juncture, since the reciprocating plate 45 is in the position of the undamaged bill holding bar 48, the temporary holding bar 49 is set in its inclined state, but the aforementioned operation is not effected at the time of this operation of storing damaged bills.

In other words, at the time of storing damaged bills, the lower end of the storing front plate 40 presses down the unlocking end 128b of the temporary hold restricting plate 128 (refer to FIG. 8) and lowers the engaging end 128a, thereby releasing the engagement thereof with the front edge 113b of the moving plate for supporting the temporary holding bar 49. Since the movement urging plate 123, which moves this moving plate 113, is stopped in the position shown in the figure, the temporarily holding operation is not effected.

Next, upon completion of the loading of the damaged bills, the holding plates 136 and 137 are rotated and set horizontally with respect to the storing front plate 40, and the clamping of the damaged bills is released. At the same time, the storage bottom plates 38 and 39 (belt 39a), which have been moved for stand-by, are returned to their original positions, and the storing front plate 40 and the holding plates 136 and 137 are subsequently raised (refer to FIG. 11 F), and are further rotated and retracted to the side where they will not affect the accumulation of the bills, as shown in FIG. 11 A.

Meanwhile, after the storing front plate 40 and the temporarily holding plates 136 and 137 have been raised, the reciprocating plate 45, which has been in the position of the undamaged bill holding bar 48, begins to retreat to the rear plate 46 side, and when the reciprocating plate 45 begins to move the damaged bills further to the damaged bill holding bar 47, the damaged bill holding bar 47 retreats upwardly as in the case of the operation of the setting of the reciprocating plate 45 at the time of storing undamaged bills, and the damaged bills already stored and the bills to be newly stored are put together.

Subsequently, when the reciprocating plate 45 moves the damaged bills further and passes the position of the damaged bill holding bar 47, the damaged bill holding bar 47 is lowered, thereby stopping the movement of the reciprocating plate 45.

Upon completion of the storage of the damaged bills, the reciprocating plate 45 advances toward the side of the front plate 44, and the undamaged bill holding bar 48 retreats upwardly as in the case described above. At the same time, the temporary holding bar 49 is rotated horizontally for stand-by, and the undamaged bills are clamped between the front plate 44 and the reciprocating plate 45. In this state, the undamaged bills advance further to the opening side for paying out, and the operation returns to the initial state as shown in FIGS. 1 and 2.

At the time when the undamaged bill holding bar 48 has retreated upwardly for stand-by, the front plate locking plate 78 is in the state shown in FIG. 5. However, since the front plate locking plate 78 and the coupling lever 81 are arranged so as to be capable of engaging and disengaging with each other, when the front plate 44 advances, the engaging roller 75 of the coupling member 74 of the front plate 44 slowly pushes up the upper edge of the front locking plate 78.

Accordingly, when the front plate 44 is set in its initial position, the front plate 44 is automatically locked by means of the front plate locking plate 78.

The aforementioned operation completes the operation of storing undamaged and damaged bills.

Although not particularly related to the gist of the present invention, a brief description will be made of the disbursing operation, distribution, operation, initial setting, and operation at the time of completion of work.

When paying operation is undertaken, bills are paid out from the disbursing bill storing part 19 to 21 of the relevant denomination and are conveyed to the accumulating and feeding section 5 along the disbursing route. In the course of this procedure, in a case where any abnormality is detected in the disbursing bill feed discriminating part 56, said bill(s) is fed to the discrimination route 10 and the distribution route 13 via the transfer route 58 and is returned to the storing part 19 to 21 of the relevant denomination of the bill(s) paid out.

When all the bills accumulated in the accumulating and feeding section 5 are undamaged and can be disbursed, bills to be disbursed are delivered from the accumulating and feeding section 5 to the depositing and disbursing bill storing section 3 by means of a delivering mechanism (not shown), and the shutter 4 is opened, thereby making it possible to take out the bills.

On the other hand, in a case where an instruction for distribution has been issued (automatically or by the input of an instruction), the undamaged bills inside the receiving and dispensing box 43 are fed out to the disbursing route 55, and are further fed to the discrimination route 10 via the transfer route 58.

In the discrimination route 10, the bills are discriminated by the discriminating section 11 with regard to the denomination and obverse and reverse sides, and bills in the obverse state of each denomination are distributed to and accumulated in the respective storing parts 19 to 21 by denomination by means of the distribution route, while bills in the reverse state are distributed to and accumulated in the second storing part 23, while other bills of abnormal feed (undamaged bills in respect of which some abnormality was detected and those bills of a denomination whose corresponding storing part 19, 20 or 21 is full) are distributed and accumulated in the first storing part 22.

Thus, since both of the bills in the first and second storing parts 22 and 23 are undamaged ones, they are stored by conducting the aforementioned operation of storing undamaged bills twice at the time of the disbursing operation described earlier.

As the bills in the reverse state are accumulated in the second storing part, the conveying direction is reversed, and these bills in the reverse state are handled as obverse bills during the next operation of distribution.

Next, with regard to the operation of the initial setting, undamaged bills (obverse) of each denomination are first set in the undamaged bill storing section of the receiving and dispensing box 43 (between the front plate 44 and the reciprocating plate 45), and are loaded in the machine body 1 (no bills have yet been accumulated in the machine body 1).

Then, if an instruction for the initial setting is issued, the same operation as the aforementioned operation of distribution is effected, and undamaged bills are accumulated in each storing part 19 to 21, thereby making it possible to deal with them.

Lastly, upon issuance of an instruction for completion of operation when the work is completed, the undamaged bills in each feeding accumulating part 19 to 21 are fed out consecutively, and are all accumulated in the first storing part 22 via the discrimination route 10 and the distribution route 13.

As the specified number of undamaged bills are accumulated, the bills inside the first storing part 22 are consecutively stored as undamaged bills as in the case of the above-described operation of storing undamaged bills, and when all the undamaged bills inside the paying bill storing parts 19 to 21 are housed inside the depositing and dispensing box 43, the operation of collection at the time of completion of work is completed.

According to the present invention, bills are housed inside the front feeding portion of the receiving and disbursing box so that undamaged bills can be distributed as disbursable ones after bills received are sorted out into undamaged and damaged bills. Furthermore, at the time when the receiving and dispensing box is withdrawn from the machine body, the disbursing opening is closed by the openable cover, and at the time when the receiving and dispensing box is mounted in the machine body, the front and lower sides of undamaged bills in a released state are pressed by the front surface guide plate and the lower end surface guide plate, thereby preventing the occurrence of any malfunction. At the same time, the alignment between the feeding roller, etc., which is incorporated in the machine body, and neither guide plates is affected by any error in mounting the receiving and dispensing box. Accordingly, the present invention produces, among others, an effect whereby it becomes constantly possible to dispense undamaged bills accurately, thereby enhancing the reliability of a circulating-type depositing and disbursing machine.

What is claimed is:

1. A circulation-type bill depositing and disbursing machine where received bills are reused as disbursed bills, said machine comprising:

a received bill storing section for storing undamaged and damaged bills;

a receiving and dispensing box removably mounted in the machine for receiving and storing the undamaged and damaged bills therein and for dispensing undamaged bills; and a disbursing bill storing section for accumulating the undamaged bills fed from said receiving and dispensing box in accordance with the denomination of the bills and for disbursing the bills to a user;

said receiving and dispensing box including an openable cover at its front side through which the undamaged bills are fed to the disbursing bill storing section, an undamaged bill storing section in a front portion of the box and a damaged bill storing section in a rear portion of the box, an upper opening provided on an upper cover of the box for receiving the undamaged and damaged bills from the receiver bill storing section, means for holding the undamaged bills therebetween and allowing the undamaged bills to move in a horizontal direction and means for holding the damaged bills therebetween and allowing the damaged bills to move in a horizontal direction.

2. A machine according to claim 1, wherein said undamaged bill holding means comprises two plates movable in a horizontal direction while holding the undamaged bills therebetween and a vertically movable temporary holding bar for temporarily holding the undamaged bills in cooperation with the plates.

3. A machine according to claim 1, wherein said damaged bill holding means comprises two plates movable in a horizontal direction while holding the damaged bills therebetween and a vertically movable holding bar for holding the damaged bills in cooperation with the plates.

4. A circulation-type bill depositing and disbursing machine where received bills are reused as disbursed bills, said machine comprising:

a receiving and dispensing box removably mounted in the machine for receiving and storing the undamaged and damaged bills therein, and for dispensing undamaged bills; and a disbursing bill storing section for accumulating the undamaged bills fed from said receiving and dispensing box in accordance with the denomination of the bills and for disbursing the bills to a user;

said receiving and dispensing box including a cover openable in the machine, and the machine including a kick-out roller and a feeding roller for coupling said receiving and dispensing box and a disbursing route of said disbursing bill storing section and for withdrawing undamaged bills from said receiving and dispensing box, and a friction-separating member for separating and feeding the undamaged bills.

5. A circulation-type bill depositing and disbursing machine according to claim 4, wherein a front surface guide plate and a lower end surface guide plate are provided inside the machine so as to press the front and lower surface of undamaged bills exposed through said openable cover.

* * * * *